United States Patent [19]

Stolz

[11] 4,251,752

[45] Feb. 17, 1981

[54] SOLID STATE ELECTRONIC BALLAST SYSTEM FOR FLUORESCENT LAMPS

[75] Inventor: James B. Stolz, Redwood City, Calif.

[73] Assignee: Synergetics, Inc., Burlingame, Calif.

[21] Appl. No.: 36,391

[22] Filed: May 7, 1979

[51] Int. Cl.[3] ..... H05B 41/26; H05B 41/29

[52] U.S. Cl. ..... 315/206; 315/208; 315/DIG. 7

[58] Field of Search ..... 315/206, 208, DIG. 7

[56] References Cited

U.S. PATENT DOCUMENTS

| | | | |
|---|---|---|---|
| 3,890,537 | 6/1975 | Park et al. | 315/DIG. 7 X |
| 4,042,856 | 8/1977 | Steigerwald | 315/208 X |
| 4,109,307 | 8/1978 | Knoll | 315/205 X |
| 4,127,795 | 11/1978 | Knoll | 315/224 X |

*Primary Examiner*—Alfred E. Smith

*Assistant Examiner*—Thomas P. O'Hare

*Attorney, Agent, or Firm*—Keith D. Beecher

[57] ABSTRACT

An electronic solid state system is provided for starting and operating one or more fluorescent lamps, and which supplies power to the lamps at a relatively high frequency, and at a relatively high power factor. The system includes a circuit which forces the line current to be proportional to the applied input voltage so as to maintain high power factor concomitantly with the removal of flicker by high frequency operation. High power efficiency is achieved through the use of a switching resonant inverter output circuit which is ideally suited to fluorescent lamp applications because of its low harmonic energy content, and because it can accommodate a wide range of resistive loads at high efficiency. The system may also incorporate a dimming circuit for the fluorescent lamps.

10 Claims, 6 Drawing Figures

SOLID STATE ELECTRONIC BALLAST SYSTEM FOR FLUORESCENT LAMPS

BACKGROUND

Fluorescent lamps have a negative resistance characteristic once the gas in the lamp is ionized. This means that as current begins to increase through the lamp, the resistance of the lamp decreases. This resistance decrease causes the current further to increase, so that unless some current limiting ballast means is provided, the lamp will be destroyed. Thus, a ballast system is required which will enable the lamp to operate at a sufficiently high current for proper illumination, but will prevent the current from increasing to a level at which the lamp will destroy itself. In addition, the lamp exhibits a very high effective resistance until the gas within the lamp ionizes, at which time a much lower resistance is presented. For that reason, the fluorescent lamp requires a high starting voltage in order that the lamp may be ionized. For many years the iron core transformer ballast system, which applies power to the lamp at a frequency of 60 Hz, was the only type available, which was capable of providing a high starting voltage and of limiting the normal operating current to an appropriate level, and it was extensively used despite its several undesirable characteristics. The undesirable characteristics of the iron core transformer ballast system include low power efficiency, irritating audible buzz, high weight, the requirement for a substantial amount of iron, and a light flicker which has a tendency subliminally to make people uncomfortable.

Attempts to improve the power efficiency of fluorescent lamp ballast systems in general in the prior art have lead to the provision of solid state high frequency electronic ballast systems. High frequency is desired, because both the ballast system and the fluorescent lamps themselves are more efficient at frequencies above 400 Hz. The prior art solid state systems originally were large and complex and were only applicable to central distribution systems for controlling a number of fluorescent lamps. Recently in the prior art, however, smaller high frequency solid state ballast systems have become available which are capable of being operated in conjunction with individual fluorescent lamp fixtures. These more recent solid state ballast systems have the advantage over the prior art iron core ballasts in that they are of smaller size, less weight, need substantially less iron, produce virtually no audible noise, and have a potential for less light flicker and increased power efficiency.

There is no question but that solid state electronic ballast systems will replace all conventional iron core ballasts in the near future, particularly as the cost of electrical energy increases, and as capability and reliability of the solid state ballast systems improve.

Solid state electronic ballast systems prior to the present invention have manifested certain problems which have prevented such prior art systems from fully realizing their potential advantages. The electronic solid state ballast system of the present invention, as will be described herein embodies unique concepts and techniques which solve the problems encountered with the prior art systems, thereby advancing the state of the art for solid state electronic high frequency ballast systems.

The problem encountered with the prior art solid state ballast systems is that after the fluorescent lamp has reached its ionization state, it exhibits negative resistance characteristics as noted above. This means that its resistance varies inversely with applied power or current. This negative resistance characteristic is normally more easily controlled by iron core transformers than by solid state circuitry. This is because most of the appropriate solid state circuits are constant voltage output devices which cannot accommodate the extreme reduction in the effective resistance of the fluorescent lamp when its gas ionizes. The solid state ballast system of the present invention, however, as will be described, overcomes the problems by using a resonant inverter whose impedance is matched to the particular fluorescent lamp being operated, and which is ideal for ballast purposes. Resonant inverters are similar to constant current devices, that is, they can accommodate loads varying all the way from open circuit to a total short circuit, and this feature renders resonant inverters well suited for use in fluorescent lamp ballast systems.

A second major problem encountered in the use of solid state ballast systems in the prior art, and one that has not been adequately solved prior to the present invention, is that of power factor. Power factor is the ratio of real power to reactive voltamperes, and it is important in determining the utility transformer and power line rating. A power factor of 95% is generally considered the minimum acceptable by the power companies. Below this, larger transformers and wire sizes become necessary to deliver a given real power to the user. For that reason, it is common practice for the power companies to charge a premium to large scale power users who have poor power factors.

The prior art electronic ballast systems which incorporate inverters have dealt ineffectively with the two apparently conflicting requirements, that is, a high power factor and a minimal light flicker. Minimal light flicker is obtained only when the direct current voltage driving the inverter in the ballast system is substantially constant, that is, only when the direct current drive voltage exhibits relatively small 60 Hz ripple. The usual means for reducing the 60 Hz ripple is to filter the direct current voltage with a large filter capacitor. Unfortunately, such a large filter capacitor causes the line current to flow in short pulses, and a poorer power factor results.

The ballast system of the present invention includes a circuit which removes the conflict between obtaining both a good power factor and minimum light flicker. This circuit causes the alternating current line current to vary proportionally and in phase with the alternating current line voltage, thus providing a good power factor. Power factors of greater than 98% are typically obtained by the system of the present invention, as compared with 97% for iron core ballasts. Moreover, light flicker of no more than 2% is obtained by the system of the present invention, as compared with 35%–40% for the iron core ballasts.

The invention provides, therefore, an electronic solid state ballast system which operates to control either standard or energy saving fluorescent lamps, and which uses 25%–30% less power than the prior art iron core ballasts while providing the same visible light output. Moreover, the electronic ballast system of the invention provides a virtually flicker-free light output, a high utility line power factor, and either alternating current or direct current operation. The ballast system of the invention also provides a dimming control for the fluorescent lamps.

The ballast system of the invention supplies power to the fluorescent lamp at high frequency, which in a typical embodiment is greater than 20 KHz. This high frequency operation permits the electronic ballast system of the invention to be substantially smaller in size and more power efficient than the prior art iron core ballast. The fluorescent lamp operated by the system of the invention it itself more efficient, that is, it produces more lumens per watt, at the higher frequency. An additional benefit of the high frequency operation obtained by the system of the invention is that the time between cycles is shorter than lamp plasma relaxation time which allows the lamp to be dimmed effectively as will be described.

As explained above, prior art solid state electronic ballast systems prior to the system of the present invention were forced to trade off between 60 Hz light output flicker and an acceptable utility line power factor. Relatively little flicker could be achieved by the prior art systems, but only at the expense of poor power factor. The system of the present invention solves this problem in that substantially all flicker is removed, and yet the power factor is still maintained greater than 95%. Moreover, the system of the invention achieves a high power efficiency through the use of a switching resonant inverter output circuit, which will also be described.

DETAILED DESCRIPTION OF THE ILLUSTRATED EMBODIMENTS

Figure 1:
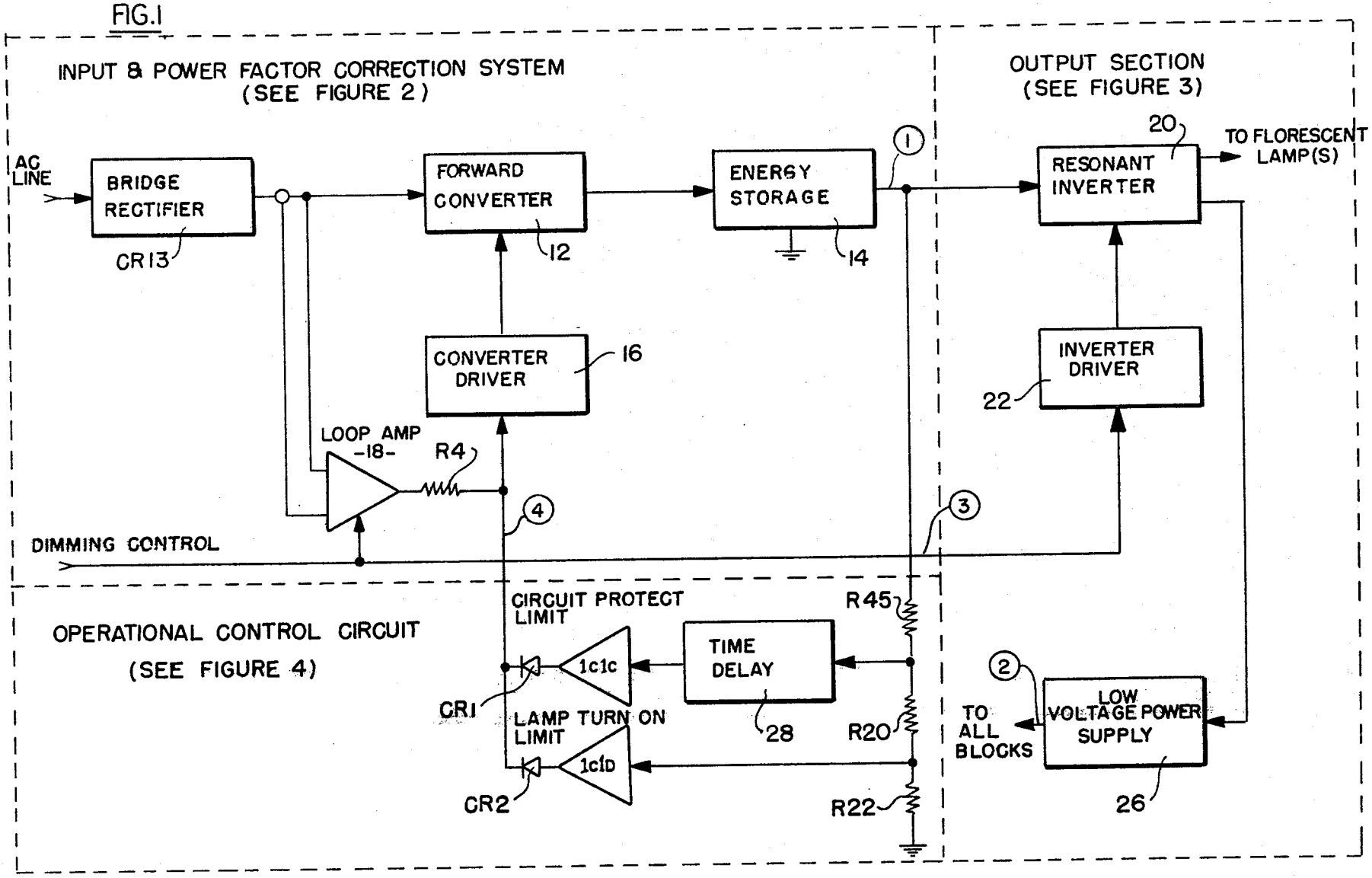
FIG. 1 is a block diagram of a solid state electronic ballast system representing a presently preferred embodiment of the invention.

The system of FIG. 1 includes, as illustrated, an input and power factor correction section, an output section and an operational control section. The input and power factor correction section, which is shown in more detail in FIG. 2, includes a bridge rectifier CR13, a forward converter circuit 12, an energy storage circuit 14, a D.C.-D.C. converter driver 16 and a loop amplifier 18.

The energy storage circuit 14 is connected to a D.C.-A.C. resonant inverter circuit 20 in the output section. A dimming control circuit is also connected to loop amplifier 18 in the input and power factor correction section, and through an inverter driver 22 to the resonant inverter 20 in the output section. The resonant inverter is also connected to a low voltage power supply 26 which supplies direct current voltage to all the circuits in the system. The output section is shown in more detail in FIG. 3.

Figure 4:
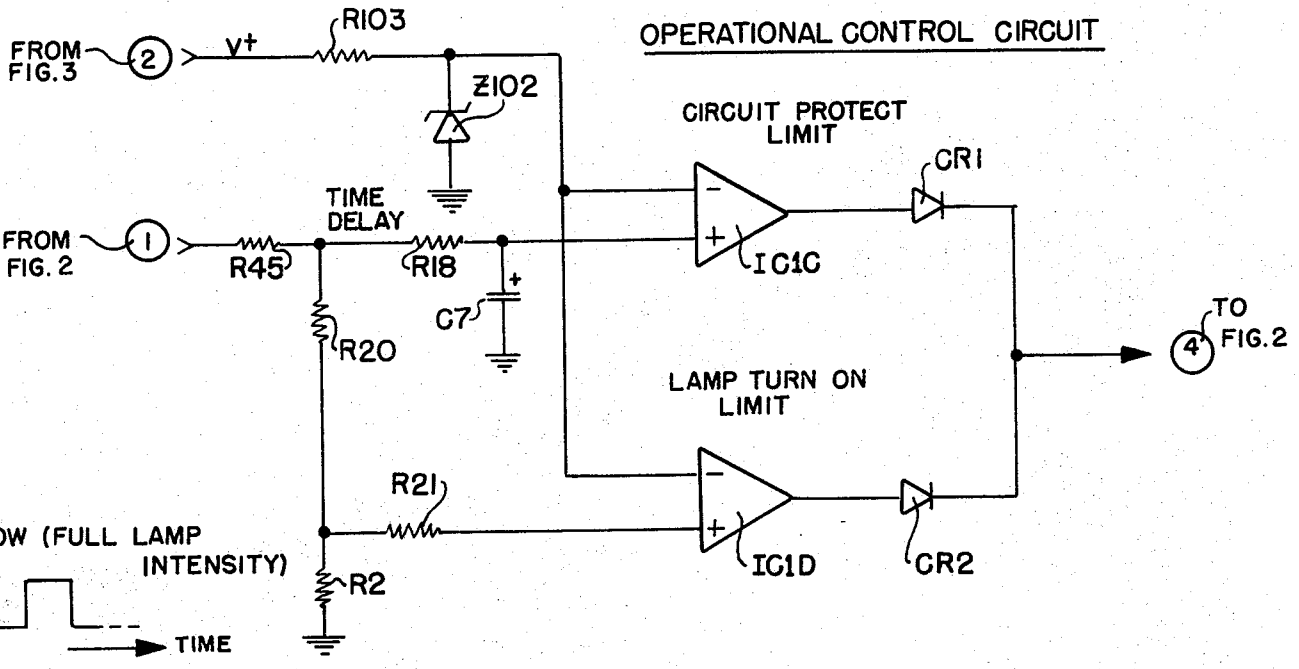
FIG. 4 is a more detailed circuit diagram of an operational control circuit which is also included in the system of FIG. 1.

The operational control section of the system of FIG. 1, which is shown in more detail in FIG. 4, includes a time delay circuit 28 which is connected to the junction of a pair of resistors R45 and R20, and whose output is connected to a comparator IC1C. A further comparator IC1D has its input connected to the junction of resistor R20 and a further resistor R22. The resistors R45, R20 and R22 are connected between the output of the energy storage circuit 14 and ground. The outputs of comparators IC1C and IC1D are connected through diodes CR1 and CR2 to the converter driver 16. Loop amplifier 18 is connected to the converter driver 16 through a resistor R4. The output of resonant inverter 20 is connected to the fluorescent lamp, or lamps, controlled by the ballast system.

The alternating current line voltage is rectified in bridge rectifier CR13 in the system of FIG. 1, and the resulting rectified direct current voltage is applied to forward D.C.-D.C. converter circuit 12 in the power factor correction section. The forward converter circuit 12 charges up a capacitor in the energy storage circuit 14, the capacitor serving to smooth out low frequency ripple and to maintain a fairly constant direct current voltage level to drive the resonant inverter 20 in the output section.

The resonant inverter 20 converts the direct current voltage from the forward converter 12 into high frequency pulses, and applies the pulses to an inductance-capacitance resonant network included in the resonant inverter 20. The energy from the resonant inverter circuit is transformer coupled to the fluorescent lamp controlled by the system. The pulses are also stepped down through a transformer and rectified in the low voltage power supply 26 to provide a relatively low direct current voltage for operating the various circuits in the system.

The operational control section of the system of FIG. 1 provides a high initial output voltage to the fluorescent lamp for a short time interval to start the fluorescent lamp. The output of the operational control circuit is limited to prevent it from exceeding the voltage rating of the fluorescent lamp.

Dimming of the fluorescent lamp is achieved by reducing the input of the loop amplifier 18, and by simultaneously causing inverter driver 22 to reduce the duty cycle of resonant inverter 20. Reducing the input level of the loop amplifier 18 forces a reduction in power drawn from the alternating current line. The duty cycle of the resonant inverter 20 must also be reduced to maintain the output voltage of energy storage circuit 14 from falling below the peak alternating current line voltage.

Figure 2:
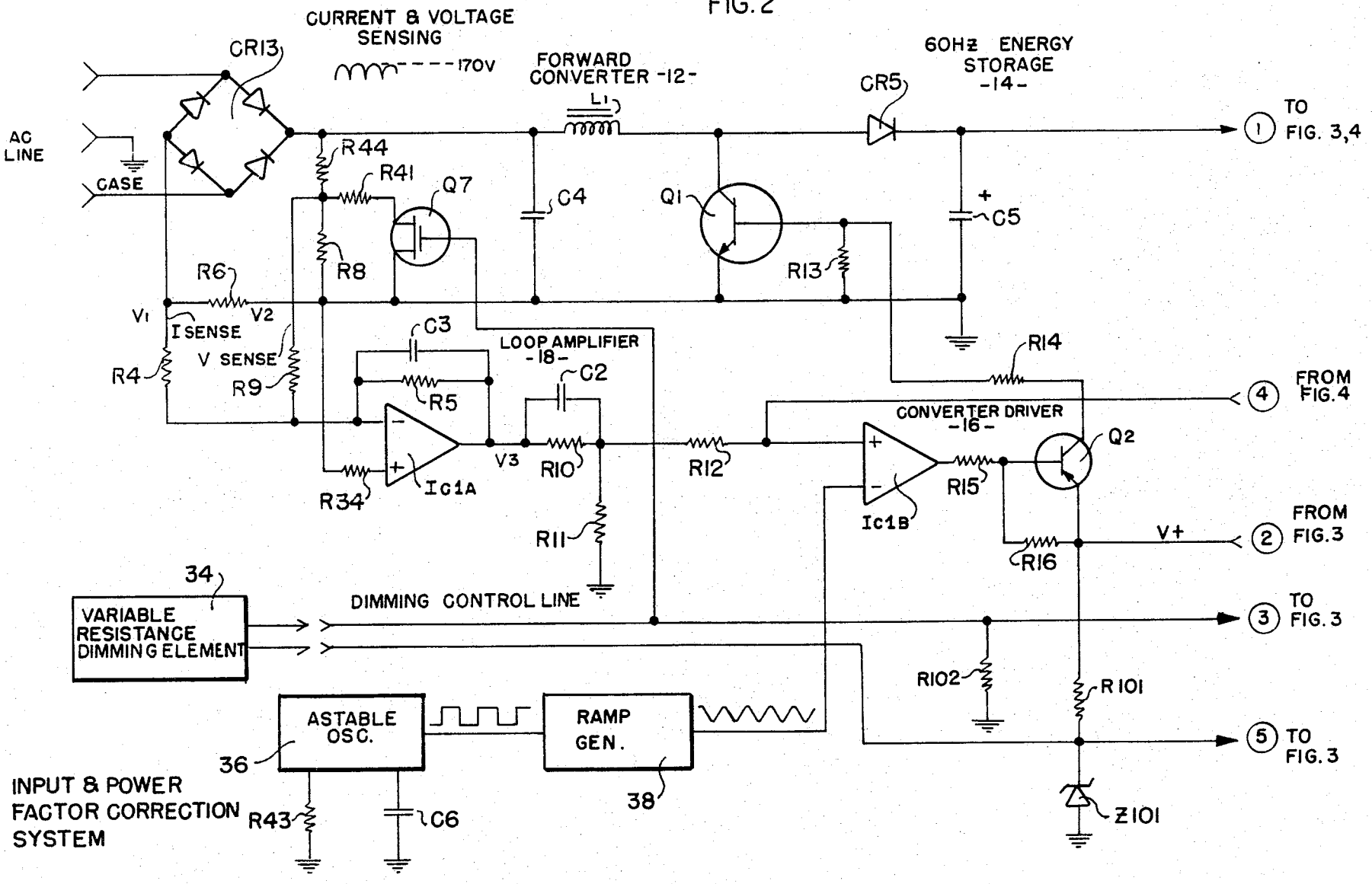
FIG. 2 is a more detailed circuit diagram of a power factor corrector circuit which is included in the system of FIG. 1.

The input and power factor correction section of the system of FIG. 1 is shown in circuit detail in FIG. 2. As shown in FIG. 2, the bridge rectifier CR13 is connected to resistors R44, R6 and R4. The resistor R44 is connected to a grounded resistor R8, and resistor R6 is also grounded. Resistor R44 is also connected through a further resistor R41 to the drain electrode of a field effect transistor Q7. The source electrode of the field effect transistor is grounded. A capacitor C4 is connected across resistors R44 and R8. The emitter of an NPN transistor Q1 is grounded, and a choke coil L1 is connected to the collector of the transistor. A grounded capacitor C5 is included in the energy storage circuit 14, and the collector of transistor Q1 is connected through a diode CR5 to capacitor C5. The base of transistor Q1 is connected to a grounded resistor R13.

The resistor R4 is connected to the negative input terminal of amplifier IC1A which forms the loop amplifier 18. The positive input terminal of the amplifier is connected to a resistor R34 which, in turn, is connected to ground. The negative input terminal of amplifier IC1A is connected through a resistor R9 to the junction of resistors R44 and R8. The output of amplifier IC1A is connected back to the negative input through a resistor R5 which is shunted by a capacitor C3. The output of amplifier IC1A is also connected to a resistor R10 which, in turn, is connected to the junction of a pair of resistors R11 and R12. Resistor R10 is shunted by a capacitor C2, resistor R11 is grounded, and resistor R12 is connected to the positive input of an amplifier IC1B in converter driver 16. The output of amplifier IC1B is connected through a resistor R15 to the base of a PNP transistor Q2. The collector of transistor Q2 is connected through a resistor R14 to the base of transistor Q1. Resistor R15 is connected through resistor R16 to the emitter of transistor Q2 which is connected to a positive voltage V+ derived from power supply 26 in the output section (FIG. 1).

A variable resistance dimming control circuit 34 is connected to a dimming control line which, in turn, is connected to the gate electrode of field effect transistor Q7, and to a grounded resistor R102. The line is also connected to the inverter driver 22 in the output section (FIG. 1). A second output line from the variable resistance dimming control is connected to the junction of a resistor R101 and a Zener diode Z101, and to the output section of FIG. 3.

The circuit of FIG. 2 also includes an astable oscillator 36 which is connected to a grounded resistor R43 and a grounded capacitor C6. A square wave is derived from the astable oscillator, and the square wave is introduced to a ramp generator 38 which, in turn, generates a ramp wave which is introduced to the negative input of the converter driver circuit 16.

The alternating current input to the circuit of FIG. 2 is full-wave rectified by bridge rectifier CR13, and the resulting pulsating direct current voltage is applied to the forward D.C.-D.C. converter 12. The converter 12 is made up of capacitor C4, choke coil L1 and transistor Q1. The converter 12 produces, for example, a 200 volt direct current output voltage across capacitor C5 in the energy storage circuit 14. The converter generates an output direct current voltage greater than its peak input voltage by making use of the flywheel effect in choke coil L1.

When transistor Q1 is rendered conductive, current builds up in the choke coil, and when the transistor Q2 is rendered non-conductive, the energy stored in the magnetic field of the coil causes the current to continue to flow in the same direction. The voltage across the non-conductive transistor Q1 then rises above the voltage across capacitor C5, and current flows into capacitor C5 and charges the capacitor to a direct current voltage of approximately 200 volts. The diode CR5 is a fast-recovery rectifier which prevents any significant discharge of capacitor C5 through transistor Q1 when the transistor is conductive.

In the preferred embodiment, transistor Q1 is rendered conductive and non-conductive at a rate of approximately 30 KHz. The on/off duty cycle of the transistor is not fixed, but rather is made to vary as required to obtain the optimum power factor. The power factor is defined to be:

$$\text{Power factor} = \frac{\text{WATTS}}{\text{RMS VOLTS} \times \text{RMS AMPERES}}$$

For a given input voltage to the forward converter 12, the input current is a function of the duty cycle of transistor Q1. If the duty cycle of transistor Q1 were held constant, the input current would not be in strict proportion to the input voltage, assuming a constant direct current output voltage. By varying the duty cycle of transistor Q1 as necessary to keep the input current sinusoidal and in phase with the input voltage, the optimum power factor is obtained.

In order to maintain optimum power factor, the input current is made proportional to the input voltage at a given input power level. At 135 watts input, which is the typical power required to light a standard fluorescent lamp fixture with the same lumen output as with a conventional ballast, the input current at time t must be as follows in order to achieve unitary power factor:

$$\begin{aligned}\text{Input Current} &= \frac{135\ \text{Watts}}{\text{Input Voltage}} \\ &= \frac{270 \cos^2 \omega t}{120 \sqrt{2} \cos t} \\ &= 1.59 \cos \omega t\end{aligned}$$

where $\omega$ is the alternating line frequency in radians/seconds.

Thus, it is desired that:

$$\frac{\text{Input Voltage}}{\text{Input Current}} = \frac{120 \sqrt{2} \cos \omega t}{1.59 \cos \omega t} = 106.7$$

It is desired to make the error signal such that:

$$\text{Error} = \left[ \frac{\text{Input Voltage}}{106.7} - \text{Input Current} \right] \longrightarrow 0 \quad (1)$$

If this error signal is obtained, amplified appropriately, and used to control the duty cycle of the forward converter 12 so that the error signal tends toward zero, the maximum power factor will be achieved. This is precisely what is accomplished by the power factor correction circuitry of FIG. 2.

The resistors R44 and R8 form a voltage divider which divides the output voltage of bridge rectifier CR13 (which is equal in magnitude to the alternating current line voltage) by approximately 474 in the preferred embodiment. Resistor R6 is a low value resistor used for sensing the current from the bridge rectifier CR13, which current is equal in magnitude to the alternating current line current. The value of resistor R6 used in the preferred embodiment is 0.225 ohms. Thus, the voltage developed across resistor R6 is equal to 0.225 volts per ampere of input current.

The loop amplifier IC1A in amplifier circuit 18 is a lead-lag compensated summing amplifier which produces an output V3 in the preferred embodiment:

$$V3 = 500\,(V1 + V2)$$

where:

$$V2 = \text{Input Voltage}/474$$

and:

$$V1 = 0.225 \text{ Input Current}$$

as described above.

Thus:

$$V3 = 500\left[\frac{\text{Input Voltage}}{474} - (.225)\text{ Input current}\right] \quad (2)$$

or:

$$V3 = 112.5\left[\frac{\text{Input Voltage}}{106.7} - \text{Input Current}\right]$$

Equation (2) is identical to equation (1) except for a multiplication constant. The voltage V3 is the amplifier error signal which, as previously discussed, can be used to control the duty cycle of the forward converter 12 to achieve a high power factor. A closed loop feedback system is thereby formed.

A variable duty cycle square wave is produced by the amplifier IC1B in the converter driver amplifier circuit 16, which amplifier compares the output of loop amplifier IC1A with the high frequency ramp signal derived from ramp generator 38. The frequency of the ramp signal is determined by resistor R43 and capacitor C6. As the voltage at the non-inverting (positive) input of amplifier IC1B varies, it matches the ramp voltage at different times during the ramp cycle, changing the duty cycle of the square wave present at the output of amplifier IC1B, and which is introduced to the base of transistor Q2. Transistor Q2 provides the necessary current amplification to drive the base of the switching transistor Q1 in the forward converter 12. Resistor R15 provides current limiting for the base of transistor Q2, and resistor R16 provides a low base-to-emitter resistance in order to turn off the transistor Q2 rapidly. Resistors R14 and R13, in the same manner, provide current limiting and rapid turn off for transistor Q1.

The feedback loop system employed in the power factor corrector circuit of FIG. 2, like any feedback system, has a tendency to be unstable if not properly compensated to provide adequate phase and gain margin at the cross-over frequency, that is, at the frequency at which the feedback loop gains equals unity. The loop amplifier IC1A is lag compensated by the network C3 and R5, and is lead compensated by the network R10, R11 and C2.

Therefore, in normal operation, the amount of power drawn from the alternating current line is determined by the current and voltage sensing proportionality constants set by resistors R44, R8 and R6. Changing the value of any one of these resistors will change the input power. To dim the lamps, input power must be reduced. In the illustrated embodiment, this reduction is accomplished by shunting resistor R8 with resistor R41 and field effect transistor Q7. The field effect transistor Q7 is an enhancement mode field effect transistor which acts as a variable resistor. As the gate voltage of the field effect transistor increases, the effective resistance of the field effect transistor decreases, and this causes a reduction in the power drawn from the line.

It will be appreciated, of course, that other embodiments of the invention may use other standard methods for changing the loop gain, including but not limited to the use of phototransistors, photodiodes, photoresistors, or the like.

Dimming of the fluorescent lamps controlled by the illustrated solid state electronic ballast system is accomplished as follows: In normal, full intensity operation, the variable resistance dimming control circuit 34 is set to maximum resistance. This makes the voltage at the gate of field effect transistor Q7 close to zero, and the field effect transistor exhibits maximum resistance. The voltage at the junction of resistors R44 and R8 ($V_{sense}$) is then determined strictly by the ratio of the two resistors. As the resistance of the dimming control 34 is reduced, the voltage at the gate of field effect transistor Q7 increases, reducing the effective drain-source resistance of the transistor. This latter resistance shunts resistor R8, reducing the $V_{sense}$ voltage to the input of loop amplifier IC1A. Since the circuit feedback control operates so as to force $[V_{sense} - I_{sense}] \rightarrow 0$ the current drawn by the ballast system is forced to decrease in proportion to the decrease in $V_{sense}$, and the power drawn from the alternating current line decreases.

The amount of power drawn from the alternating current line, and hence the lamp intensity, in the dimmed mode is a function of the voltage at the gate of field effect transistor Q7. This voltage would tend to vary with alternating current line voltage and other external parameters if it were not for the regulator circuit of Zener diode Z101 and resistor R101. This regulator circuit provides a constant voltage to the dimming control circuit so that the intensity of the fluorescent lamp in the dimmed mode is stable, and is a function only of the resistance of the dimming control circuit 34.

The dimming control circuit 34 may comprise a variable resistance potentiometer. However, the control circuit is not limited to a potentiometer, but may comprise any element, passive or active, which presents a varying effective resistance to the dimming lines extending from the control circuit 34. This includes, but is not limited to a fixed resistor in series with a switch for step dimming, or a photocell or photo-active circuitry combination to provide ambient light dimming.

As the power input is reduced to effect lamp dimming, the voltage across the energy storage capacitor C5 would tend to decrease to an unacceptable value if the effective load on the capacitor were not also changed. The voltage at the output of the forward converter 12 must always be greater than the peak input voltage from the rectifier bridge CR13 if the converter is to function properly. To maintain the input voltage of the converter 12 above this minimum level as the controlled fluorescent lamp is dimmed, the duty cycle of the resonant inverter 20 in the output section must be reduced to raise the effective resistance of the circuit supplied by the forward converter 12. For this reason the dimming control lines from the variable resistance dimming element 34 also control the resonant inverter 20 of FIG. 3 through driver 22. As dimming occurs, the duty cycle of the resonant inverter 20 is reduced by an amount which maintains the voltage across capacitor C5 in the energy storage circuit approximately constant.

Figure 3:
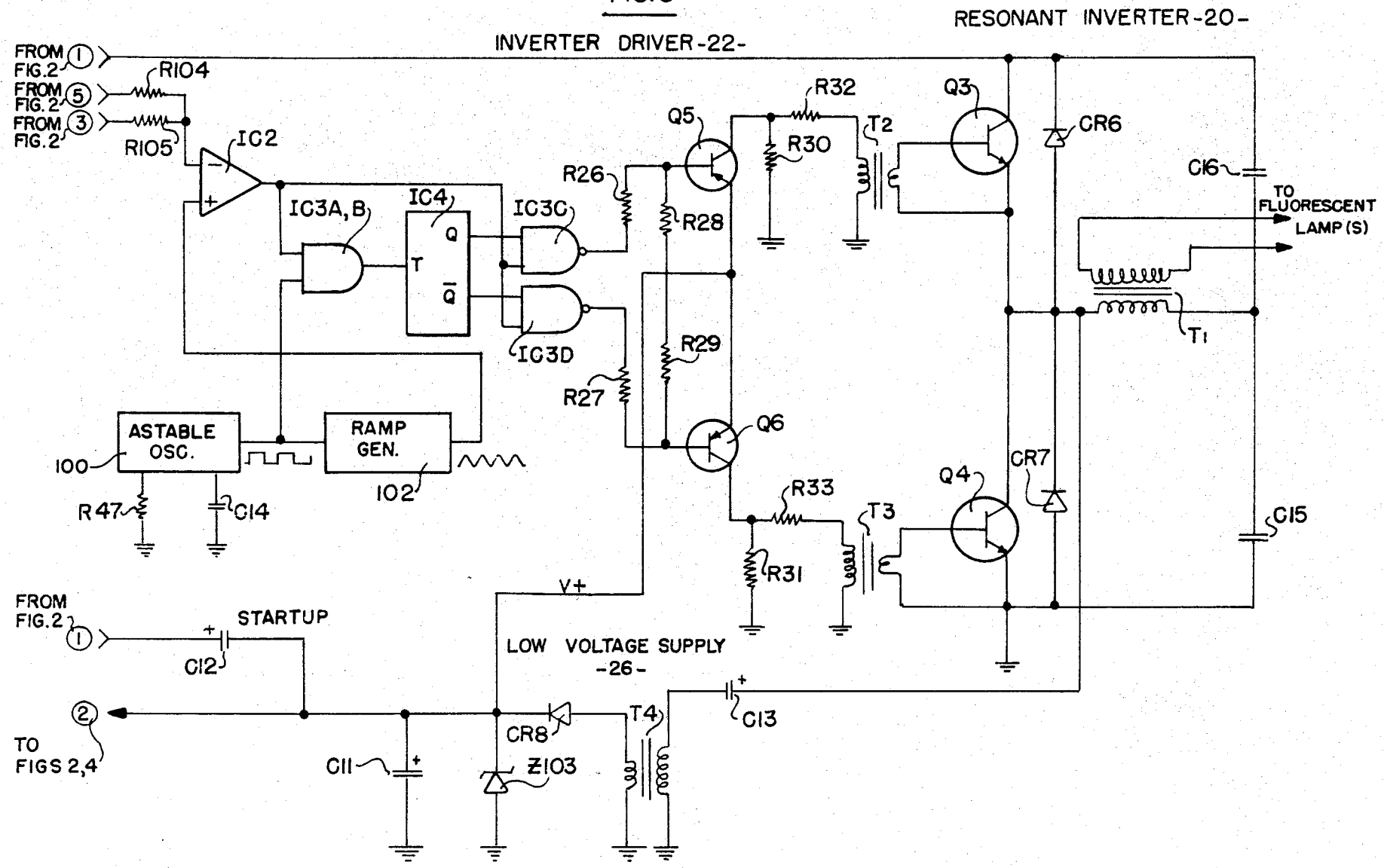
FIG. 3 is a more detailed circuit diagram of a resonant inverter output circuit which is also included in the system of FIG. 1.

The output section of the system of FIG. 1, which includes the resonant inverter 20, the inverter driver 22 and the low voltage power supply 26 is shown in more detail in FIG. 3. As shown in FIG. 3, the inverter driver includes an amplifier IC2 whose inverting input is connected through a resistor R104 to terminal 5, and through a resistor R105 to terminal 3, these terminals being connected to the circuit of FIG. 2. The output of amplifier IC2 is connected to an "and" gate IC3A,B and to a pair of "nand" gates IC3C and IC3D. The output of "and" gate IC3A,B is connected to the T input of a flip-flop IC4. The Q output of flip-flop IC4 is connected to "nand" gate IC3C, and the $\overline{Q}$ output of the flip-flop is connected to "nand" gate IC3D. An astable oscillator 100 is provided which includes a resistor R47 and a capacitor C14. The astable oscillator provides a square wave output which is introduced to "and" gate IC3A,B and to the input of a ramp generator 102. The ramp output of ramp generator 102 is connected to the noninverting input of amplifier IC2.

The output of "nand" gate IC3C is connected through a resistor R26 to the base of a PNP transistor Q5, the collector of which is connected to a grounded resistor R30 and through a resistor R32 to the primary of a transformer T2, the other side of the primary being grounded. Likewise, the output of "nand" gate IC3D is connected through a resistor R27 to the base of a PNP transistor Q6, the collector of which is connected to a grounded resistor R31 and through a resistor R33 to the primary winding of a transformer T3, the other side of the primary being grounded. The base and emitter of transistor Q5 are bridged by a resistor R28, and the base and emitter of transistor Q6 are bridged by a resistor R29. The emitters of transistors Q5 and Q6 are interconnected. The secondary of transformer T2 is connected across the base and emitter of an NPN transistor Q3, and the secondary of transformer T3 is connected to the base of an NPN transistor Q4, and to the grounded emitter of that transistor.

The collector and emitter of transistor Q3 are bridged by a diode CR6, and the collector and emitter of transistor Q4 are bridged by a diode CR7. The emitter of transistor Q3 and the collector of transistor Q4 are connected to one side of the primary winding of a transformer T1. The other side of the primary winding is connected to a grounded capacitor C15 and to a capacitor C16 which, in turn, is connected to the collector of transistor Q3. The secondary of transformer T1 is connected to the fluorescent lamps controlled by the system.

The collector of transistor Q4 and emitter of transistor Q3 are coupled through a capacitor C13 to the primary winding of a step-down transformer T4 in the low voltage power supply 26. The secondary of transformer T4 is connected through a diode CR8 to terminal 2 which, in turn, is connected to the circuits of FIGS. 2 and 4, and through a capacitor C12 to terminal 1, which, in turn, is connected to the circuit of FIG. 2. The diode CR8 is connected to a grounded Zener diode Z103 and to a grounded capacitor C11. The foregoing components constitute the low voltage supply circuit 26, and supply a B+ voltage to the circuit of FIG. 3, as shown, and to the circuits of FIGS. 2 and 4. The start-up voltage is received from the circuit of FIG. 2 by way of terminal 1.

The frequency of operation of resonant inverter 20 is determined by resistor R47 and capacitor C14 in FIG. 3. The output frequency of the astable oscillator 100 controls the output frequency of the ramp generator 102, which equals twice the operating frequency of the inverter 20. Integrated circuits IC3 and IC4 perform the logic functions necessary to obtain two complementary square waves. Amplifier IC2 allows the duty cycle of the square waves to be varied in accordance with the voltage at its inverted input. As previously mentioned, the duty cycle of the resonant inverter 20 must be decreased to accomplish dimming of the flourescent lamps controlled by the system.

Figure 6:
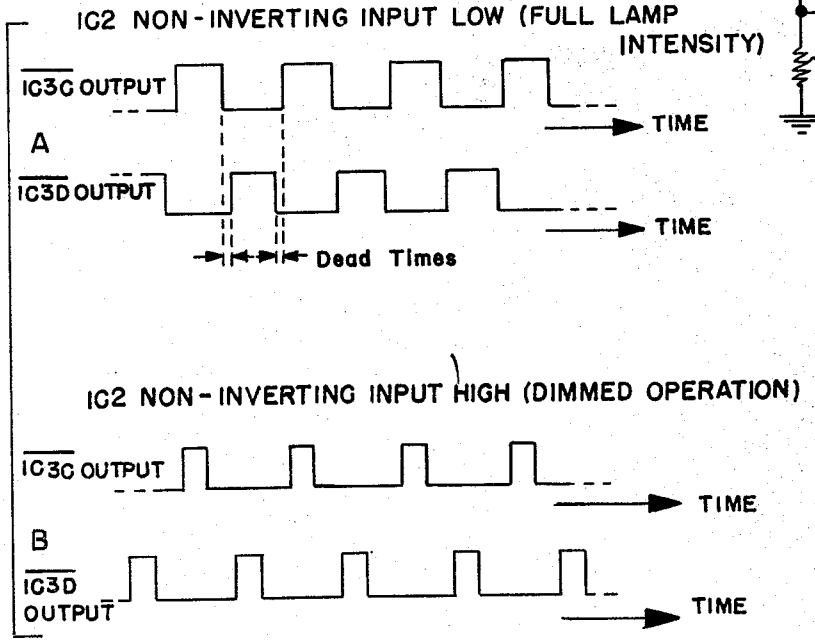
FIG. 6 are curves useful in explaining the operation of the system.

The inverter drive inputs from the "nand" gates IC3C and IC3D are shown in the curves A and B of FIG. 6. In normal operation at maximum lamp intensity (curves A), a small "dead time" is provided to prevent simultaneous conduction of the inverter switching transistors Q3 and Q4. This is required because of the nonzero transistor charge storage and rise times. In the dimmed mode, the duty cycle is reduced (curves B). This increases the effective impedance of the circuit being supplied by current from capacitor C5 of FIG. 2.

Transistors Q5 and Q6 provide current amplification to provide ample current to the bases of transistors Q3 and Q4. Resistors R32 and R33 limit the current to the primaries of pulse transformers T2 and T3. The pulse transformers serve a dual purpose; the first purpose is voltage isolation since the emitter of transistor Q2 is at an elevated potential, and the second purpose of the transformers is to turn off the transistors Q3 and Q4 rapidly in order to minimize the maximum dead time interval. When transistor Q5 or Q6 is non-conductive, the resulting negative potential on the secondary winding of transformer T2 or T3 serves to drain the charge out of the base of transistor Q3 or Q4, thus rapidly rendering the respective transistors non-conductive.

The high voltage peak-to-peak square wave at the junction of the emitter of transistor Q3 and the collector of transistor Q4 drives a resonant circuit consisting of the primary winding of transformer T1, capacitor C15 and capacitor C16. The resonant frequency of the resonant circuit is chosen so that a half-cycle of current flows between switching intervals, and switching occurs when the current through transistors Q3 and Q4 is approximately zero. Since a large part of the power inverter losses are normally incurred in the transistors Q3 and Q4 as they switch between the conductive and non-conductive states, the above described technique minimizes these power losses.

The resonant inverter circuit 20 is ideally suited to operate the fluorescent lamps controlled by the system. The resistance of the fluorescent lamps affects the circuit as if it were a resistance in series with the primary coil of the output transformer T1. When the lamp turns on, the ionization of the lamp gas causes the lamp load to change from a nearly open circuit to a very low resistance. This lowers the effective resistance in series with the primary of transformer T1, resulting in a lower total voltage in the secondary of the transformer. Therefore, the change in lamp load is accommodated by a corresponding change in the output voltage, so that the lamp driver could be characterized more accurately as a current source than as voltage source.

The foregoing characteristic is useful in many ways. For example, the ballast will not be damaged by either an open circuit or a short circuit at its output. As the lamp ages, the voltage output of the ballast will change as required to maintain a constant lumen output. Also, with the ballast system of the invention, it is unnecessary to heat the filaments of rapid-start type fluorescent lamps, because the initial output voltage is sufficiently high to start the lamps even with cold filaments.

The logic state circuitry of the system of the invention which performs the required logic functions and drives the bases of the switching transistors Q5 and Q6 must operate at a voltage well below the rectified line voltage. To obtain this voltage with a simple voltage divider would be much too inefficient, and a low voltage transformer operating from the alternating current input would be unnecessarily large. Therefore, in the circuit of FIG. 3, the low voltage is derived by using a pulse signal from the resonant inverter circuit 20 as the input to the transformer T4 which is a small high frequency transformer.

The input to the low voltage supply circuit 26 is derived at the junction of the emitter of transistor Q3 and the collector of transistor Q4. This input is a high voltage square wave. Capacitor C13 blocks the direct current voltage component of the square wave, and transformer T4 transforms the voltage of the square wave down to the desired level. The low voltage is then rectified by diode CR8 and filtered by capacitor C11 to provide the appropriate direct current low voltage level. Minimal filtering is required because the ripple frequency is very high as compared with the typical alternating current line frequency.

Since the low voltage for the system is derived from the resonant inverter 20, and the resonant inverter needs low voltage to operate, an additional element, namely capacitor C12, is required so that the system of the invention will begin normal operation when power is first applied from the alternating current line. When power is first applied, capacitor C5 in the energy storage circuit 14 of FIG. 2 is forced to charge rapidly to the input voltage of the circuit of FIG. 3. This rapid rise of voltage across the capacitor C5 is introduced to the low voltage line through capacitor C12. The charging time of capacitor C12 is long enough to allow the low voltage line to reach the potential (V+) required for the inverter 20 and converter 12 to begin normal operation. From then on, the low voltage supply circuit 26 effectively sustains the system. Zener diode Z103 limits the maximum voltage present on the low line voltage line (V+) at the time of initial turn on.

The circuitry described above not only provides a very efficient way to obtain the low voltage, but also results in a fail-safe operation. That is, should any component fail which disables either the inverter 20 or converter 12, the inverter output voltage will go to zero. Since the low voltage supply 26 derives its input from the inverter 20, its voltage will also go to zero and will shut down the drive circuitry, preventing damage to the overall system.

The operational control section of FIG. 1 is shown in more detail in FIG. 4. The +V voltage from the low voltage supply 26 of FIG. 3 is introduced by way of terminal 2 to a resistor R103 which, in turn, is connected to the non-inverting inputs of comparators IC1C and IC1D. Resistor R103 is also connected to a grounded Zener diode Z102.

The common junction of resistors R45 and R20 is connected through a resistor R18 to the non-inverting input of amplifier IC1C, and resistor R18 is also connected to a grounded capacitor C7. The junction of resistors R20 and R22 is connected through a resistor R21 to the non-inverting input of amplifier IC1C. The output of comparator IC1C is connected through diode CR1 to the converter driver 16 of FIG. 2 by way of terminal 4, and the output of comparator IC1D is connected through diode CR2 to that terminal.

The operational control circuitry of FIG. 4 provides a higher initial voltage across capacitor C5 in the energy storage circuit 14 of FIG. 2 when the circuit is first turned on to start the fluorescent lamp or lamps driven by the system. Then, once the lamps have been turned on, this circuit monitors the voltage across the capacitor C5 to prevent it from exceeding the maximum component ratings.

When power is first applied, or when the system is energized with the controlled lamp or lamps disconnected, there is no load on the resonant inverter 20. At such times the output voltage of the forward converter 12, that is the voltage across capacitor C5, would tend to rise to a very high value. The operational control circuit of FIG. 4 limits the voltage to a safe value. The voltage is allowed to rise slightly during the short time interval after alternating current line power is first applied to the system in order to assure the starting of the fluorescent lamp or lamps energized by the system. When the lamps ignite, and the normal load is placed on the forward converter 12, the voltage across capacitor C5 drops to its normal operating value. A circuit-protect limit is then put on this voltage by the operational control circuit, in case the fluorescent lamps are disconnected or change substantially with age.

A voltage divider consisting of resistors R45, R20 and R22 samples the voltage across capacitor C5. The division ratio is such that if the voltage across capacitor C5 exceeds the circuit-protect limit for more than the time delay provided by time delay circuit 28 of FIG. 1 which is formed by resistor R18 and capacitor C7 in FIG. 4, the voltage at the output of amplifier IC1C will go high. If the voltage across capacitor 15 exceeds the lamp turn-on limit, the output of comparator IC1D will go high. The outputs of comparators IC1C and IC1D are OR'ed through diodes CR1 and CR2, and are then applied to the duty cycle control line of the forward converter 12.

When the output of either comparator IC1C or IC1D goes high, as a result of an over-voltage condition, the duty cycle of the forward converter 12 is reduced to a value which keeps its output voltage within the appropriate limits. The resistor R103 and Zener diode Z102 supply a regulated reference voltage to keep the limit boundaries table.

It should be pointed out that the embodiment of the invention described above is not limited to any particular type of flourescent lamp and, with appropriate changes in the output transformer T1 of FIG. 3, as to turns ratio and component values, virtually any size lamp or lamps can be operated of either the rapid start type or instant start type. In some cases when more than one lamp is to be operated by a single system, it is desirable that the lamps be independent of one another, so that if one lamp fails the others will continue to operate normally. The embodiment of the invention shown in FIG. 5 provides the latter capability.

Figure 5:
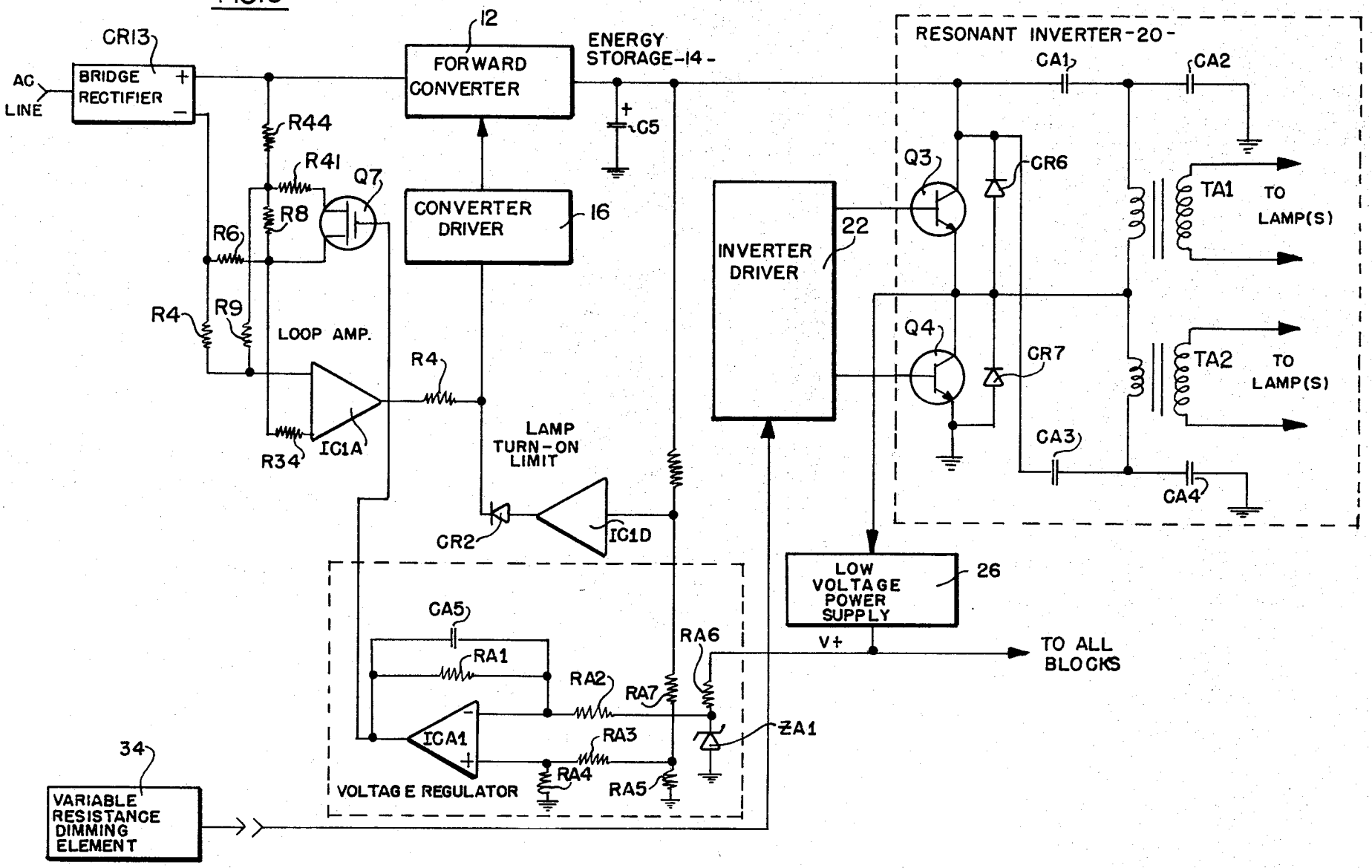
FIG. 5 is a diagram, partly in block form and partly in circuit detail, representing a second embodiment of the invention.

Many components of the embodiment of FIG. 5 are similar to the previous embodiment, and have been designated by the same numerals. The changes in the embodiment of FIG. 5 as compared with the previous embodiment are enclosed within the illustrated broken lines. In the resonant inverter 20, the transformer T1 is replaced by a pair of transformers TA1 and TA2 connected as shown, and capacitors CA1 and CA2 are provided, as are capacitors CA2 and CA4.

The operational control circuit includes a voltage regulator which, in turn, includes an amplifier ICA1 whose output is connected to the field effect transistor Q7, and the regulator circuit includes resistors RA1, RA2, RA3, RA4, RA5, RA6 and RA7 connected as shown, as well as a capacitor CA5, and a Zener diode ZA1.

In the embodiment of FIG. 5, a first resonant inverter output section, which is made up of capacitors CA1 and CA2, and transformer TA1, operates independently of the second resonant inverter output section, which is made up of capacitors CA3 and CA4, and transformer TA2. For a given type and quantity of lamps, however, the impedance seen by the transistors Q3 and Q4 is the same as was the case in the previous embodiment with the single resonant circuit output.

Since the objective of the embodiment of FIG. 5 is for independent operation of the fluorescent lamps, the failure or removal of the load from one resonant output circuit must not affect the load on the other resonant output circuit in any significant manner. To accomplish this, the direct current voltage to the resonant inverter must be regulated. Otherwise, when one lamp fails, the voltage to the resonant inverter would increase, as the system attempted to deliver a constant power to the load.

The voltage regulator circuit of amplifier ICA1 performs the necessary regulation. The regulator circuit samples the voltage across capacitor C5, compares it to a reference voltage supplied from Zener diode ZA1, and outputs an amplified difference signal to the control element of field effect transistor Q7. The resistance of field effect transistor Q7 is caused to change, which changes the input alternating current power, with the objective of maintaining a constant voltage across capacitor C5 in the presence of varying load conditions. The capacitor CA5 and resistor RA1, connected between the negative input and the output of amplifier ICA1, determine the loop gain and cross-over frequency of the feedback regulator system to assure stable operation.

With the exception of the multiple resonant output circuit of the resonant inverter, and the voltage regulator described above, the circuitry of the embodiment of FIG. 5 is similar to the above-described circuitry of the previous embodiment. It should be pointed out, however, that the embodiment of FIG. 5 is not limited to two independent outputs, but can have any number of independent output circuits, as required for the number of lamps to be controlled by the system.

The embodiment of FIG. 5 may still include the option of full range dimming, as was the case with the previous embodiment. A dimming circuit which presents a variable effective resistance may be connected to the resonant inverter driver circuit in the manner described for the previous embodiment. By varying the effective resistance of the dimming circuit, the duty cycle of the output pulses of the driver circuit are changed, causing the lamps controlled by the system to use more or less power. The voltage regulation feedback circuit in the embodiment of FIG. 5 will automatically adjust the forward converter gain to maintain the voltage across the capacitor C5 constant while the lamps are being dimmed. Thus, in the embodiment of FIG. 5, the dimming element does not have to directly control the gain of the forward converter loop amplifier, as was the case in the previous embodiment.

The system of the present invention provides, therefore, a highly efficient resonant inverter which drives one or more fluorescent lamps, and which is uniquely suited in obtaining the greatest amount of light output per watt. The ballast system of the invention is dimmable either in a step or continuous manner. During the dimming operation, the power drawn from the alternating current line decreases proportionately as the light intensity is reduced, and is approximately 50% at the 50% light level. The system of the invention provides essentially constant light intensity, with a typical flicker of the order of 2%, as compared with 35%-40% of conventional ballasts. The reduction of flicker achieved by the system of the invention while maintaining a utility line power factor at least as good as that of the conventional ballasts.

The ballast system of the invention can be powered directly from direct current with the same energy savings as for alternating current operation. The embodiments of the invention described herein may be constructed to be of the same size as one prior art conventional ballast, and yet they may operate four 40 watt fluorescent lamps whereas the conventional ballast is capable of operating only two. The ballast system of the invention produces no audible sound due to its high frequency operation, whereas the usual prior art conventional ballast has a tendency to buzz. Moreover, the total amount of iron required for the ballast system of the invention is considerably less than that required in the conventional prior art ballast.

It will be appreciated that while particular embodiments of the invention have been shown and described, modifications may be made. It is intended in the claims to cover the modifications which come within the true spirit and scope of the invention.

What is claimed is:

1. An electronic solid state ballast system for at least one fluorescent lamp comprising: a rectifier circuit responsive to alternating current power from an alternating current source for producing a direct current voltage; a converter circuit connected to said rectifier circuit and responsive to said direct current voltage for producing a direct current output voltage; an energy storage circuit including a capacitor responsive to the direct current output voltage from the converter circuit to charge the capacitor to a substantially constant direct current voltage level, the capacitor serving to smooth out low frequency ripple in the direct current output voltage from said converter circuit; an inverter circuit connected to said energy storage circuit for converting the direct current voltage level of said capacitor into output pulses of a selected frequency; an output circuit connected to said inverter circuit for coupling said inverter circuit to at least one fluorescent lamp; a loop amplifier circuit connected to the output of said rectifier circuit; a driver circuit for the converter circuit interposed between the output of the loop amplifier circuit and the converter circuit; said loop amplifier circuit controlling the duty cycle of said converter circuit so as to maintain the input current of the system substantially in phase with the input voltage; a ramp signal source; and an amplifier included in said driver circuit, said amplifier having its input connected to said ramp signal source and to the output of the loop amplifier circuit for comparing the output of the loop amplifier circuit with the ramp signal to change the duty cycle of said converter circuit as the direct current voltage output from the rectifier circuit varies.

2. The electronic solid state ballast system defined in claim 1, in which said inverter circuit produces output pulses of a high frequency as compared with the frequency of the alternating current source.

3. The electronic solid state ballast system defined in claim 1, in which said inverter circuit includes an inductance-capacitance resonant network, and said output circuit includes a transformer for coupling energy from said resonant network to the fluorescent lamp.

4. The electronic solid state ballast system defined in claim 1, in which said rectifier circuit produces a pulsating direct current voltage, and said converter circuit includes a choke coil which responds to said pulsating direct current voltage to produce a direct current voltage across said capacitor of a value greater than the peak value of said pulsating direct current voltage.

5. The electronic solid state ballast system defined in claim 1, and which includes a power supply coupled to said inverter circuit and responsive to the output pulses therefrom for providing a direct current exciting voltage for the circuits of the ballast system.

6. The electronic solid state ballast system defined in claim 5, and which includes circuitry including a step down transformer for coupling the inverter circuit to said power supply.

7. The electronic solid state ballast system defined in claim 1, in which said loop amplifier circuit includes stabilizing lead and lag compensating network means.

8. The electronic solid state ballast system defined in claim 1, and which includes a second driver circuit connected to said inverter circuit, a variable-resistance dimming control circuit connected to the input of said loop amplifier circuit and to the input of said second driver circuit for reducing the input of said loop amplifier circuit and for simultaneously causing the second driver circuit to reduce the duty cycle of said inverter circuit, and which further includes circuit means including a field effect transistor connecting the input of said loop amplifier circuit to the output of said rectifier circuit, and circuit means connecting said dimming control circuit to the field effect transistor to enable the dimming control circuit to control the conductivity of the field effect transistor.

9. The electronic solid state ballast system defined in claim 1, and which includes a source of a ramp signal; and in which said second driver circuit includes an amplifier having an input connected to said ramp signal source and a further input connected to said variable resistance dimming control circuit for comparing the output from said dimming control circuit with the ramp signal from said source to change the duty cycle of the inverter circuit as the output from the dimming control circuit changes.

10. The electronic solid state ballast system defined in claim 1, and which includes control circuitry connected to the output of said energy storage circuit and to said converter circuit for limiting the rise of voltage across said capacitor in said energy storage circuit when the load on the inverter circuit is essentially zero, but permitting the voltage across the capacitor to rise to a sufficiently high value to initiate the firing of the fluorescent lamp controlled by the system.

* * * * *